US008840335B2

(12) United States Patent
Martin et al.

(10) Patent No.: US 8,840,335 B2
(45) Date of Patent: Sep. 23, 2014

(54) ROAD MARKER OR LIGHT BASED WARNING DEVICE

(75) Inventors: Patrick John Martin, Christchurch (NZ); Paul Senior, Sompting (GB)

(73) Assignee: Solar Bright Limited, Sydenham, Christchurch (NZ)

( * ) Notice: Subject to any disclaimer, the term of this patent is extended or adjusted under 35 U.S.C. 154(b) by 0 days.

(21) Appl. No.: 14/238,152

(22) PCT Filed: Jul. 5, 2012

(86) PCT No.: PCT/NZ2012/000118

§ 371 (c)(1), (2), (4) Date: Feb. 10, 2014

(87) PCT Pub. No.: WO2013/043061

PCT Pub. Date: Mar. 28, 2013

(65) Prior Publication Data

US 2014/0197955 A1 Jul. 17, 2014

(30) Foreign Application Priority Data

| | | |
|---|---|---|
| Sep. 11, 2011 | (NZ) | 595342 |
| Oct. 25, 2011 | (NZ) | 595950 |
| Nov. 30, 2011 | (NZ) | 596762 |

(51) Int. Cl.

| | |
|---|---|
| ***E01F 9/06*** | (2006.01) |
| ***G08G 1/095*** | (2006.01) |
| ***E01F 9/00*** | (2006.01) |
| ***G08B 5/36*** | (2006.01) |

(52) U.S. Cl.

CPC *G08B 5/36* (2013.01); *G08G 1/095* (2013.01); *E01F 9/065* (2013.01); *E01F 9/007* (2013.01)

USPC ..... 404/12; 404/16; 340/932; 340/907

(58) Field of Classification Search

USPC ..... 340/907, 932; 404/9, 12, 16

See application file for complete search history.

(56) References Cited

U.S. PATENT DOCUMENTS

| | | | | |
|---|---|---|---|---|
| 4,926,163 | A * | 5/1990 | Beebe | 340/581 |
| 5,047,406 | A | 9/1991 | Caprathe | |

(Continued)

FOREIGN PATENT DOCUMENTS

| | | | |
|---|---|---|---|
| AU | 2006202749 | A1 | 1/2007 |
| AU | 2008201394 | A1 | 11/2008 |

(Continued)

OTHER PUBLICATIONS

International Search Report of the International Searching Authority for PCT/NZ2012/000118, mailed Nov. 16, 2012. 5 pages.

(Continued)

*Primary Examiner* — Eric M Blount

(74) *Attorney, Agent, or Firm* — Perkins Coie LLP

(57) ABSTRACT

A road marker and related light based warning device are described. The road marker or device includes a thermal sensor that triggers the illumination of at least one light-emitting diode at a predetermined temperature. The temperature may be associated with ice formation. The light-emitting diode(s) may flash to alert motorists to hazardous road conditions. The road marker or device utilize simple components to increase reliability, particularly when the device is subjected to high heat such as when the device is mounted into hot tar seal. The device further includes a switching element that prevents rapid on/off cycling.

15 Claims, 8 Drawing Sheets

(56) References Cited

U.S. PATENT DOCUMENTS

| | | | | |
|---|---|---|---|---|
| 5,412,381 | A * | 5/1995 | Dicks | 340/908.1 |
| 5,897,271 | A | 4/1999 | Widmer | |
| 6,456,200 | B1 * | 9/2002 | Bostrom et al. | 340/580 |
| 6,551,014 | B2 * | 4/2003 | Khieu et al. | 404/14 |
| 6,900,740 | B2 * | 5/2005 | Bloomquist et al. | 340/905 |
| 7,018,131 | B2 | 3/2006 | Jordan | |
| 7,273,328 | B2 * | 9/2007 | Hunter et al. | 404/12 |
| 7,347,643 | B2 * | 3/2008 | Jeong | 404/13 |
| D565,447 | S * | 4/2008 | Horng | D10/113.1 |
| 7,421,894 | B2 * | 9/2008 | Keep et al. | 73/170.19 |
| 8,425,076 | B2 * | 4/2013 | Lockwood et al. | 362/153.1 |
| 2002/0003697 | A1 * | 1/2002 | Chien | 362/84 |
| 2005/0270175 | A1 * | 12/2005 | Peddie et al. | 340/907 |
| 2006/0257204 | A1 | 11/2006 | Matiosian | |
| 2006/0257205 | A1 | 11/2006 | Jordan et al. | |
| 2007/0070618 | A1 * | 3/2007 | Talamo et al. | 362/153.1 |
| 2011/0035140 | A1 | 2/2011 | Candy | |
| 2011/0135386 | A1 | 6/2011 | Sahota | |

FOREIGN PATENT DOCUMENTS

| | | | |
|---|---|---|---|
| AU | 2010224309 | A1 | 3/2011 |
| AU | 2011200971 | A1 | 9/2011 |
| EP | 0210503 | B1 | 2/1993 |
| GB | 1123354 | A | 8/1968 |
| GB | 2121460 | A | 12/1983 |
| GB | 2217363 | A | 10/1989 |
| GB | 2299358 | A | 10/1996 |
| GB | 2430787 | A | 4/2007 |
| GB | 2449979 | B | 12/2008 |
| JP | 2002256520 | A | 9/2002 |
| WO | WO 03/072880 | A1 | 9/2003 |
| WO | WO 2005/052262 | A1 | 6/2005 |
| WO | WO 2006/106789 | A1 | 10/2006 |
| WO | WO 2011/009189 | A1 | 1/2011 |

OTHER PUBLICATIONS

International Preliminary Report on Patentability for PCT/NZ2012/000118, completed Mar. 20, 2013. 16 pages.

* cited by examiner

ROAD MARKER OR LIGHT BASED WARNING DEVICE

RELATED APPLICATIONS

This application is a 35 U.S.C. 371 National Stage Application of PCT/NZ2012/000118, filed Jul. 5, 2012, which claims priority to New Zealand patent application numbers 595342, 595950 and 596762, each of which is incorporated herein by reference.

TECHNICAL FIELD

The application relates to a road marker or light based warning device. More specifically, the application relates to a road marker or device with at least one light-emitting diode that is used to warn motorists of temperature-related dangerous road conditions such as the formation of ice.

BACKGROUND ART

Reflective road markers, commonly known as cat's eyes, are used worldwide to manage traffic and maintain road safety. These markers generally include reflective material, visible both during the day and at night on exposure to light from street lamps or vehicle headlights. Road markers are widely used as they are inexpensive to produce, simple to install and need little or no maintenance yet still perform a very helpful function for motorists. While reflective road markers may be effective in managing traffic, they do not assist motorists in assessing ambient temperature and the effect of ambient temperature on driving conditions.

Driving conditions can be hazardous in the presence of ice and, in particular, black ice. Black ice is generally known as a thin coating of glazed ice on a road or sidewalk that is transparent and, thus, may not be seen. Black ice lacks noticeable ice pellets, snow or sleet to indicate that road conditions are dangerous and that driving speed should be reduced. Bridges and overpasses may be especially hazardous, as black ice forms first on these structures due to a cooling flow of air both above and beneath the structures.

It should be appreciated that it may be useful to have a cat's eye device that serves the dual purpose of being a reflective road marker and which alerts drivers to potential safety hazards associated with ambient temperature such as ice formation.

One existing technology relating to illuminating road markers powered by solar cells may be referred to as a solar road stud as described in US2011135386A1. These markers or studs flash constantly to alert drivers to dangerous sections of road or hazardous conditions. One drawback of these existing solar road studs is that the flashing lights do not automatically switch on and off depending on changes in the conditions. They must also be activated remotely. Thus, they are useful solely on sections of road that are always hazardous to drive and which are able to be monitored, rather than on sections of road that are intermittently hazardous and/or sections that are remote from monitoring sites.

Other existing technology overcomes the problem of controlling the illumination of road markers or signs by linking them to road condition sensors and to a network or data transmission system. The network may automatically control warning signals to drivers or require remote control. A drawback of those systems is that they are expensive and complex to install, operate, maintain and repair and, hence, may be prohibitively costly to implement. They also lack flexibility in location as they must be installed proximate an external data collection point.

One patent publication JP2002-256520 proposes an alternative solution describing a road marker that continuously illuminates alternating between colours depending on the temperature. Continuous illumination in this manner is not ideal as it means parts wear out and energy use is higher than may be needed. In addition, the device described does not recognise issues surrounding rapid on-off cycling that can occur thereby resulting in problems with longevity of the circuitry and device as a whole.

SUMMARY

Described herein is a road marker or device with a thermal sensor that triggers the illumination of at least one light-emitting diode at temperatures approximate to the formation of ice thereby providing a warning to motorists of hazardous driving conditions associated with cold temperatures.

In some embodiments, there is provided a road marker comprising a housing enclosing:

(a) a circuit board;
(b) a thermal sensor coupled to an input terminal on the circuit board wherein the thermal sensor has at least 0.5° C. of hysteresis to prevent rapid on/off cycling of the at least one light-emitting diode;
(c) a photovoltaic (PV) module coupled to an input terminal on the circuit board;
(d) at least one energy storage element coupled to an input terminal on the circuit board;
(e) at least one light-emitting diode coupled to an output terminal of the circuit board;

wherein the at least one light-emitting diode or diodes illuminate when the thermal sensor detects a predetermined temperature.

In some embodiments, there is provided a road marker comprising a housing enclosing:

(a) a circuit board;
(b) a thermal sensor coupled to an input terminal on the circuit board;
(c) a photovoltaic (PV) module coupled to an input terminal on the circuit board;
(d) at least one energy storage element coupled to an input terminal on the circuit board;
(e) at least one light-emitting diode coupled to an output terminal of the circuit board wherein the at least one light-emitting diode or diodes illuminate when the thermal sensor detects a predetermined temperature; and wherein the housing is biased to a position where at least the light emitting diode or diodes in the housing sit proud of a surface to which the road marker is applied and wherein, when a force is applied against the bias direction, the housing is depressed into the surface.

In some embodiments, there is provided a road marker comprising a housing enclosing:

(a) a circuit board linked in parallel with an energy storage device, a photovoltaic (PV) module and a thermal sensor all coupled to an input terminal or terminals on the circuit board;
(b) at least one light-emitting diode coupled to an output terminal of the circuit board wherein the at least one light-emitting diode or diodes illuminate when the thermal sensor detects a predetermined temperature; and wherein the circuit includes a single forward biased diode between the PV module and the energy storage device preventing energy leakage from the energy storage device when light energy is insufficient to power the PV module.

Embodiments of the road marker and device described herein may provide a simple and cost-effective hazard indicator for mitigating accidents due to unseen road dangers such as ice. The design is such that, once installed, the road marker or device requires little maintenance. Due to the fact that the design is self-contained, it does not require expensive data transmission systems or networks in order to operate reliably. The markers or devices can also be used in remote locations as no monitoring is required. Further, the marker or device is simple in construction and comparatively inexpensive.

Further aspects and advantages of the road marker or light based warning device will become apparent from the ensuing description that is given by way of example only.

BRIEF DESCRIPTION OF THE DRAWINGS

Further aspects of the road marker or light based warning device will become apparent from the following description that is given by way of example only and with reference to the accompanying drawings in which.

DETAILED DESCRIPTION

Figure 1:
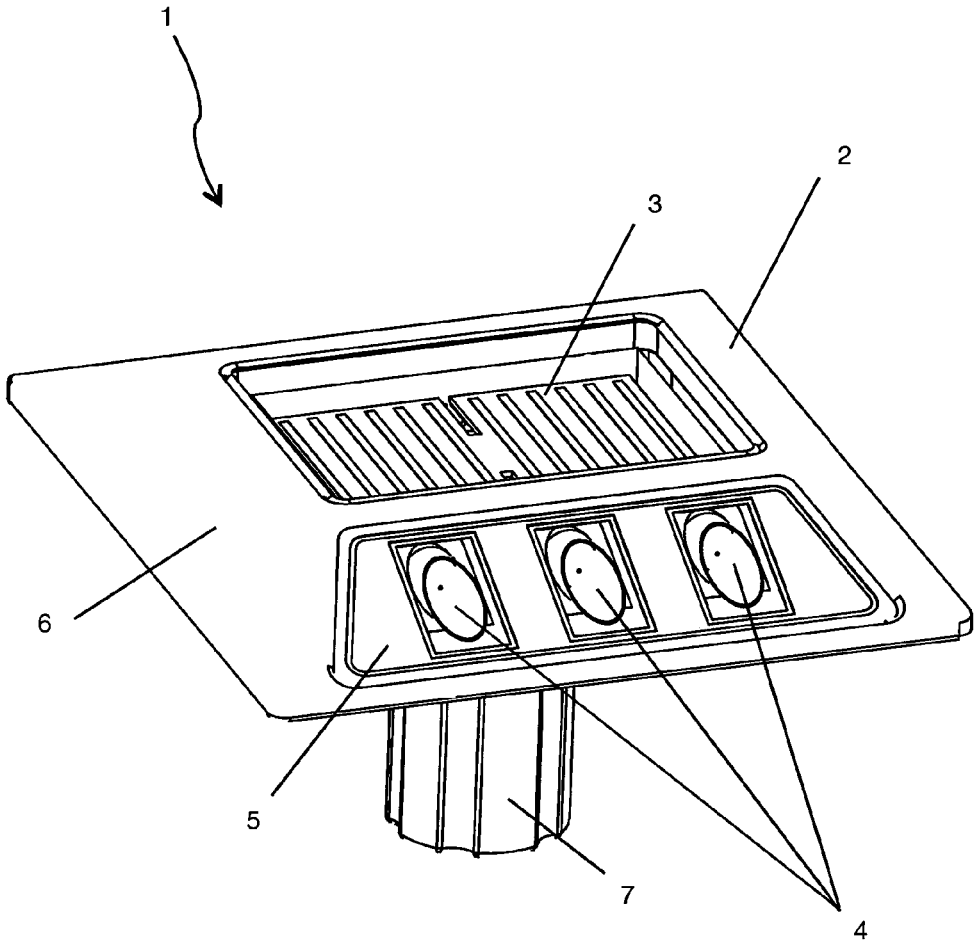
FIG. 1 illustrates a perspective view of a road marker of one embodiment.

As noted above, the application broadly relates to a road marker or device with a thermal sensor that triggers the illumination of at least one light-emitting diode at temperatures approximate to the formation of ice.

For the purposes of this specification, the term 'PV module' refers to a photovoltaic module including a plurality of solar cells, also known as a solar cell array. Photovoltaic modules generate electrical power by converting solar radiation to direct current (DC) electricity.

The term 'LED' refers to a light-emitting diode, a semiconductor light source. LED's operate over a long lifetime with low energy consumption. LED's are available in a variety of colours, any of which may be used for the current application.

The terms 'road marker', 'cat's eye', 'road stud', 'visual signalling unit' and grammatical variations thereof may be used interchangeably to describe a reflective device on a substrate such as the surface of a road used to alert drivers to changes in road conditions associated with cold temperatures.

The term 'black ice' refers to a thin coating of glazed ice on a road or sidewalk that is transparent.

The term 'self-contained' refers to the marker not having any external linkages or protruding items.

The term 'ambient temperature' refers to the temperature immediately around the marker housing.

The term 'illumination' refers to the light emitting diodes being lighted either continuously or on an off/on cycle so as to give the effect of flashing or pulsing of light from the light emitting diode or diodes, The term 'about' or 'approximately' and grammatical variations thereof mean a quantity, level, degree, value, number, frequency, percentage, dimension, size, amount, weight or length that varies by as much as 30, 25, 20, 15, 10, 9, 8, 7, 6, 5, 4, 3, 2, or 1% to a reference quantity, level, degree, value, number, frequency, percentage, dimension, size, amount, weight or length.

The term 'substantially' or grammatical variations hereof refers to at least about 50%, for example 75%, 85%, 95% or 98%.

For the purpose of this specification the term 'comprise' and grammatical variations thereof shall have an inclusive meaning—i.e. that it will be taken to mean an inclusion of not only the listed components it directly references, but also other non-specified components or elements.

In some embodiments, there is provided a road marker comprising a housing enclosing:

(a) a circuit board;

(b) a thermal sensor coupled to an input terminal on the circuit board wherein the thermal sensor has at least 0.5° C. of hysteresis to prevent rapid on/off cycling of the at least one light-emitting diode;

(c) a photovoltaic (PV) module coupled to an input terminal on the circuit board;

(d) at least one energy storage element coupled to an input terminal on the circuit board (e) at least one light-emitting diode coupled to an output terminal of the circuit board;

wherein the at least one light-emitting diode or diodes illuminate when the thermal sensor detects a predetermined temperature.

Applicants have found that existing road marker devices exhibit rapid on/off cycling of the lights in the event of a temperature on or around the pre-set measurement at which the light or lights are activated. Art methods to avoid this include manual switching on or off or use of a micro-controller. Manual adjustment is not ideal as it requires labour and time and the markers cannot simply be installed and left to operate. Micro-controllers lack the resilience of passive componentry as will be described in more detail below plus micro-controllers carry a higher cost making the devices less desirable for mass use and production. Avoiding the need for manual switching, micro-controllers and yet addressing the issue of rapid cycling via introduction of a moderate to high degree of hysteresis in the switch is ideal from a cost and reliability point of view.

The thermal sensor may be a bimetallic switch wherein the switch shape and metal selection are designed to confer the desired degree of hysteresis. Alternatively, the thermal sensor may be a thermocouple or a thermistor again designed to have the desired level of hysteresis.

Hysteresis is often avoided in switches where an accurate off/on tolerance is usually favoured. In the case of the marker and devices described herein, the opposite is true where a degree of hysteresis is very important to avoid the circuit turning off and on rapidly in a cycle. Instead the circuit should only turn off once a sufficiently warm temperature is reached where no ice is likely in road warning applications and only turning on and staying on when ice is a likelihood. Rapid on/off cycling may be confusing to the motorist and may result in more rapid deterioration of the componentry. The switch ideally turns the circuit on when ice is a risk and off when ice formation is no longer a risk. The exact temperature may vary from location to location.

The thermal sensor may have at least approximately 0.75° C., or 1.0° C., or 1.5° C., or 2.0° C., or 2.5° C., or 30° C., or 3.5° C., or 4.0° C. of hysteresis to prevent rapid on/off cycling of the at least one light-emitting diode.

In some embodiments, the degree of hysteresis is biased towards the light-emitting diode or diodes remaining illuminated until at least 0.5° C. or higher than the set temperature so as to ensure that temperature conditions are suitably warmer than the temperature considered hazardous.

In some embodiments, there is provided a road marker comprising a housing enclosing:

(a) a circuit board;
(b) a thermal sensor coupled to an input terminal on the circuit board;
(c) a photovoltaic (PV) module coupled to an input terminal on the circuit board;
(d) at least one energy storage element coupled to an input terminal on the circuit board;
(e) at least one light-emitting diode coupled to an output terminal of the circuit board wherein the at least one light-emitting diode or diodes illuminate when the thermal sensor detects a predetermined temperature; and wherein the housing is biased to a position where at least the light emitting diode or diodes in the housing sit proud of a surface to which the road marker is applied and wherein, when a force is applied against the bias direction, the housing is depressed into the surface.

A spring or springs may produce the bias action. Other bias mechanisms may be used such as a piston or pneumatic pusher.

The housing may be depressed into the surface when struck by a snowplough or heavy vehicle.

In some embodiments, that marker may include a hemispherical shaped housing made of a clear rubber material. This housing may enclose the componentry of the marker and the marker may be set into an aperture in the surface such as a road. A casing that mates with the housing may be used along with a bias mechanism such as a spring or springs or piston or pistons. The bias action of the bias mechanism forces the marker upwards. The casing may have a lip around the casing circumference that abuts and retains the housing within the surface aperture during normal operation. When a force is applied to the top of the housing, the housing may be depressed into the surface aperture against the bias action thereby dropping the marker within the surface. By varying the aperture depth and bias travel, the marker may be set to fully depress into the surface. When the force is removed, the bias action then forces the marker back up to a normal operation or non-depressed position. This mechanism allows the marker to depress when a downward force is applied thereby avoiding the marker being removed by a snowplough or heavy vehicle.

Alternative biased embodiments may include use of a housing in the shape of a ball, the ball shape being retained within a casing inside an aperture in a surface. The ball housing may be manufactured from a transparent and resilient material such as rubber. The marker components such as LEDs and battery may be retained within the ball. The ball housing also may include a counter weight that weights the bottom of the ball so that the marker tends to remain in position with the LED lights and a portion of the ball sitting proud of the surface. The ball may be biased up relative to the surface by a sprung bearing and the bias action forces the ball against a casing annulus. When a downward force is applied such as that experienced from a heavy vehicle or a snowplough, the ball is forced downwards against the sprung bearing. The force may also be transferred into rotational motion on the ball that is free to spin within the casing. The ball may also include a magnet or magnets (not shown) that are attracted to a magnet or magnets on the casing. The magnets may be used to slow or self-correct rotational movement of the ball in addition to a counter balance weight.

In some embodiments, there is provided a road marker including a housing enclosing;

(a) a circuit board linked in parallel with an energy storage device, a photovoltaic (PV) module and a thermal sensor all coupled to an input terminal or terminals on the circuit board;
(b) at least one light-emitting diode coupled to an output terminal of the circuit board wherein the at least one light-emitting diode or diodes illuminate when the thermal sensor detects a predetermined temperature; and wherein the circuit includes a single forward biased diode between the PV module and the energy storage device preventing energy leakage from the energy storage device when light energy is insufficient to power the PV module.

Prevention of battery leakage avoids the battery losing charge when the PV module receives no or minimal light energy. A further advantage of the above circuit layout is that it avoids the need for voltage controllers or microcontrollers to control electrical flows thereby avoiding the need for more expensive and lower reliability components.

The road marker components may all be located within the housing and there are no external parts outside the housing. Art methods often utilise external parts such as external temperature sensors or wiring linking multiple devices to one controller. The road marker described herein is a stand-alone item with no external parts meaning that installation is a simple process and maintenance is minimised.

The housing may include a sloped profile relative to the direction of on-coming or departing traffic. This slope or the slopes may aid or encourage a depressing force on the marker into the surface against the bias direction.

The surface noted in the above aspects may be a road surface but may also be a post such as a lamppost; a rail such as a handrail; a crash prevention barrier; or a median barrier.

The electrical components used in the marker described above may be passive components. The components as a whole may be selected to minimise the voltage requirement to less than 4 volts. The voltage may be minimised to a voltage requirement of less than 3.5 volts, 3 volts, 2.5 volts, 2 volts, 1.5 volts, 1 volt, 0.75 volt, 0.5 volt. An aim of minimising the voltage requirement is that the marker can be made from simple components requiring little maintenance. Low voltage requirements also serve to extend the battery life of the device when used in low light situations.

The road marker described above may be temperature resilient sufficient to withstand the temperature of tar seal during road formation. Road markers are generally fitted while tar seal is still molten or before settling hence the marker is subjected to extreme temperatures for at least a short period of time. Temperature resilience was achieved by use of a metal enclosure containing all of the marker contents along with use of passive components and not using a microcontroller. Micro-controllers in particular were found by the inventors to be particularly sensitive to temperatures experienced during road sealing plus they were also less resilient in general and compromised performance over the long term. A high level of reliability was identified by the inventors as being critical given that the marker is likely to be placed in remote locations. Having to regularly service the markers particularly when in remote locations would dramatically compromise the market proposition of the device due to greater servicing costs. The ideal device is one that is installed and largely forgotten except when needed in hazardous road conditions. The temperature resilience referred to above may be greater than 100° C. The temperature may be greater than 150° C. The temperature may be 180° C. to 200° C.

The light emitting diode or diodes may flash when the predetermined temperature is reached and light energy is received by the PV module independent of the energy level in the energy storage device. By use of a parallel circuit arrangement, the energy storage device becomes optional allowing the energy storage device to be removed or recharged independent of light illumination.

The circuit board may include an LCR circuit sufficient to generate a pulse of at least 2 volts to drive a flash from the light emitting diode or diodes. The pulse may be at least 2.5 volts, at least 3 volts, at least 3.5 volts, at least 4 volts.

The PV module may be activated by energy received from a car light or lights.

While a cat's eye road marker embodiment is generally described, it should be appreciated that other road marker devices may also utilise a similar design. The road marker device may be a beacon, road marker, flash light or other device utilising the light emitting components described. The device may be placed or fixed to a surface or fixed to an intermediate structure such as a road cone.

The PV module used in the marker or device may be located on the top surface of the housing when mounted to a surface so that it is exposed to light e.g. sunlight. The PV module may be a solar panel of greater than 0.1, or 0.2, or 0.5, or 0.75, or 1.0, or 1.25, or 1.5, or 1.75, or 2.0 volts. The PV module may be a 2-volt solar panel.

When illuminated, the road marker or device described above may produce a flashing or pulsing output. The term 'flashing output' may refer to pauses between illuminations ranging from 0.015 to 5 seconds although pauses may be more or less as desired. The term 'pulsing' may refer to the amount of light emitted from the light emitting diodes varying in brightness in a pulsed manner ranging in cycle length from 0.015 to 5 seconds although pulses may be more or less as desired. The marker may produce a flashing output at a frequency of 1-5 Hz when illuminated.

Illumination may be as a single point of light from one LED or multiple lights from one or more LED's. Where multiple LED's are used, they may be arranged so as to form a shape or word. In one embodiment, the LED's may be arranged to form the word "ICE".

The flashing output from the marker or device may be produced by the circuit board that includes a flasher circuit. The output of this circuit may be an open drain. Alternatively, the flashing output may be produced by at least one light-emitting diode containing an integrated multivibrator circuit. In a further embodiment, the at least one light-emitting diode may produce constant illumination without flashing or pulsing. Alternatively, the circuit board may be a low voltage, resistor programmable thermostatic switch wherein the thermostatic switch may include at least a temperature-specific resistor, a thermal sensor, a power supply resistor, a ground terminal and an output terminal.

The housing of the marker or device when mounted to a surface may define at least one top surface and perimeter sides wherein the top surface and perimeter sides enclose a cavity accessible at the bottom of the marker. The housing may be formed as a single piece. Alternatively, the housing may be formed from a plurality of individual pieces.

The housing may be formed from an abrasion-resistant material.

The housing may include at least one reflective surface of light-transmitting material.

At least one surface of the housing may be transparent such that the at least one light-emitting diode is visible through the housing.

A removable bottom closure on the marker or device may attach to the housing to enclose components within the housing via screws, adhesive or other attachment methods. A gasket may be placed between the housing and the removable bottom closure to prevent ingress of water or particulates. The gasket may be made of silicone or a similar deformable material.

The removable bottom closure may be manufactured from cast aluminium. Alternatively, the removable bottom enclosure may be constructed from one or more moulded components. This bottom closure may house the spring or springs providing a bias force on the marker. The bias force may instead be from a piston or spring situated between the housing and surface.

The bottom closure may be fastened mechanically (e.g. a fastener) or chemically (e.g. an adhesive) to a surface. This bottom closure may be adhesively bonded to a surface such as a road surface. Alternatively, the bottom closure may be attached mechanically or chemically to an item or items proximate to a road such as a handrail or lamppost.

The thermal sensor used in the marker or device may be contained within the removable bottom closure. Alternatively, the thermal sensor may be contained within the housing.

Placement of the thermal sensor may be to enable measurement of the ambient air temperature adjacent the road and/or marker. Alternatively, placement of the thermal sensor may be to enable measurement of the substrate, e.g. asphalt temperature.

The energy storage element used in the marker or device may be a battery. The energy storage element may be a rechargeable battery that may be trickle charged from a PV module without deterioration. The battery may be a nickel cadmium battery or another type of battery suitable for use with PV modules.

The circuit board used in the marker or device may be configured to cause the at least one light-emitting diode to illuminate when the temperature sensor measures a temperature (ambient and/or substrate) approximate when ice may form (the predetermined temperature). The illumination temperature may be less than or equal to 5° C. Alternatively, the illumination temperature may be less than or equal to 4° C., or 3.0° C., or 2.5° C., or 2.0° C., or 1.5° C., or 1.0° C., or 0.5° C., or 0.0° C., or −0.5° C., or −1.0° C., or −1.5° C., or −2.0° C., In the above aspects, the road marker or device may be self-contained. That is, there may be no parts or components outside the housing meaning that the marker or device is easy to manufacture, sell, ship and install.

As may be appreciated from the above, the road marker or device may provide a simple and cost-effective hazard indicator for mitigating accidents due to unseen road dangers such as ice. The design is such that, once installed, the road marker or device requires little maintenance. Maintenance frequency depends primarily on the life of the energy storage element, or battery. Due to the fact that the design is self-contained, it does not require expensive data transmission systems or networks in order to operate reliably.

The embodiments described above may also be said broadly to consist in the parts, elements and features referred to or indicated in the specification of the application, individually or collectively, and any or all combinations of any two or more said parts, elements or features, and where specific integers are mentioned herein which have known equivalents in the art to which the embodiments relates, such known equivalents are deemed to be incorporated herein as of individually set forth.

Where specific integers are mentioned herein which have known equivalents in the art to which this invention relates, such known equivalents are deemed to be incorporated herein as if individually set forth.

Working Examples

The marker and device are now described with reference to a detailed description of various embodiments of the road marker and device.

FIGS. 1 to 5 illustrate an embodiment of a road marker in an assembled form. FIG. 6 shows the marker in an exploded perspective view. The road marker, generally indicated by arrow 1, is shaped similar to existing cat's eye road markers. The road marker 1 includes a housing 2, being a metal enclosure with openings to receive a PV module or solar panel 3 affixed to the top surface of the housing 2 when fitted to a surface (not shown). The road marker 1 includes light-emitting diodes (LED's) 4. The LED's 4 surrounding area may include one or more reflective panels 5. The housing 2 may have sloped edges 6 to allow traffic to drive smoothly over the marker 1. The marker 1 also includes a base projection or anchor 7 emanating from the bottom of the marker 1 used to help anchor the marker 1 in place on a surface. The anchor 7 may be inserted into an aperture in the surface. The anchor 7 may include an aperture 13 to hold a battery (not shown) therein.

Figure 5:
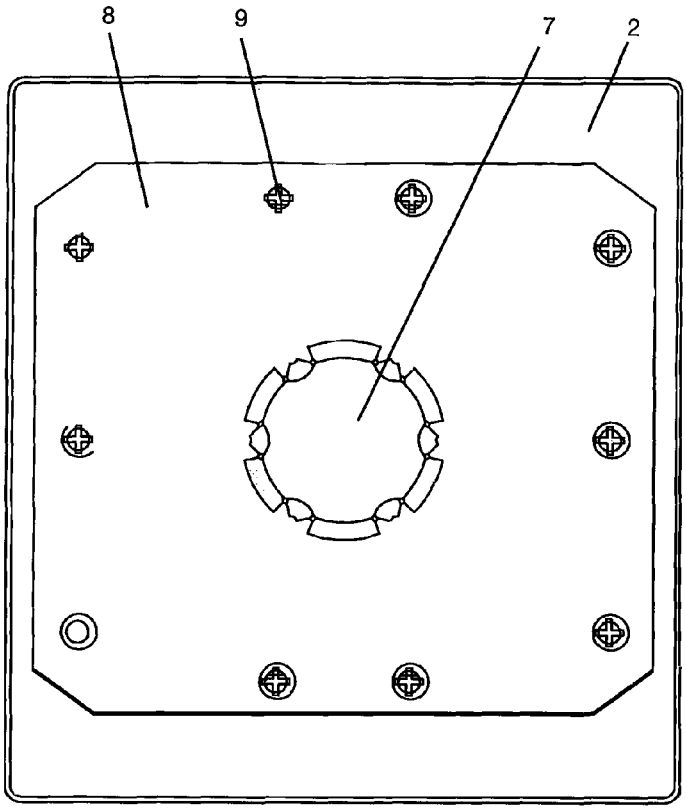
FIG. 5 illustrates an underside view of a road marker.
Figure 6:
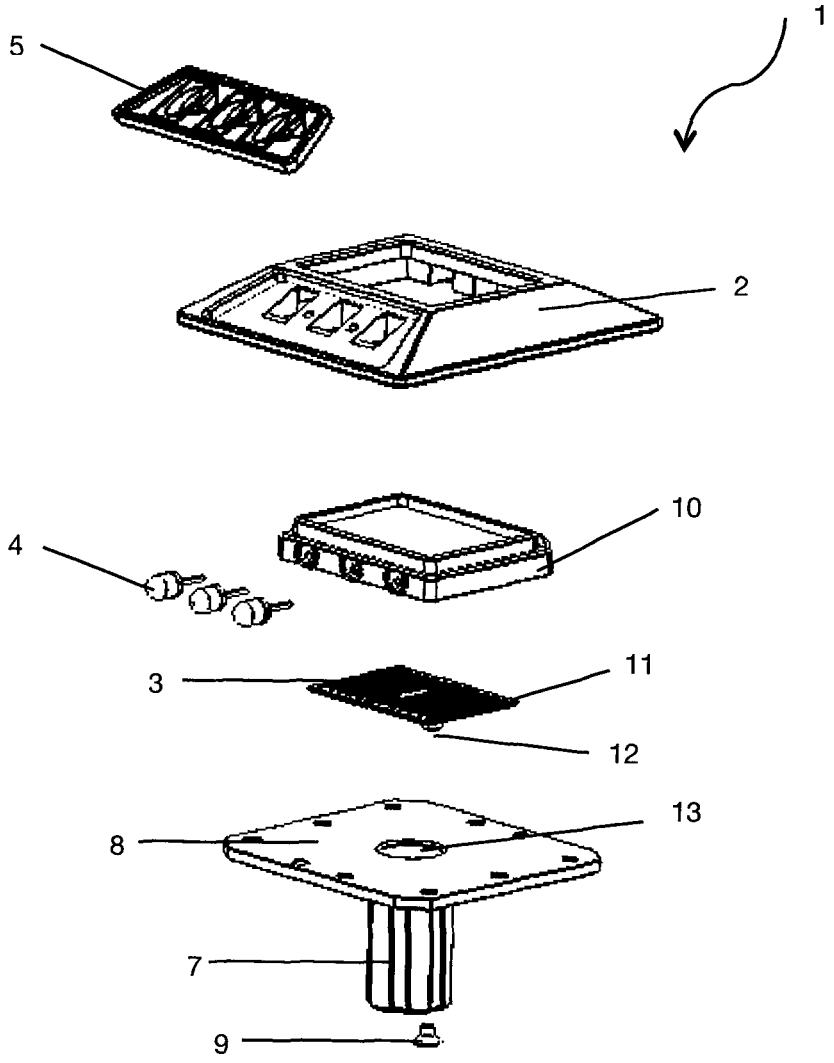
FIG. 6 illustrates an exploded perspective view of a road marker.

The bottom of the marker is shown in FIG. 5. The bottom includes a base cast aluminium shell component 8 fastened by screws (9) to the housing 2. The base 8 encloses the internal components and attaches to the housing 2.

As shown in FIG. 6, inside the housing 2 is a moulding 10 that retains the solar panel 3, the printed circuit board (PCB) 11, the sensor 12 and the lights 4 (partially).

Figure 7:
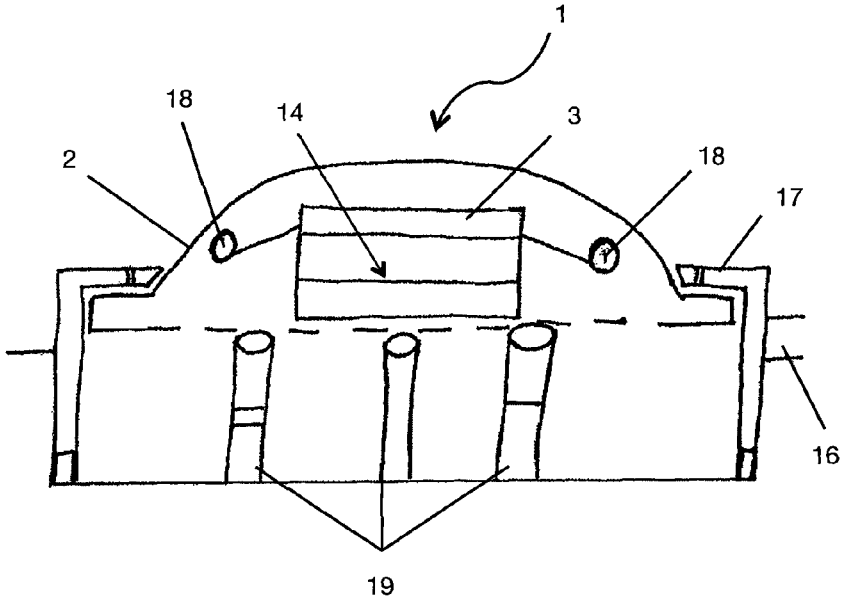
FIG. 7 illustrates one embodiment of a biased marker.

FIG. 7 shows an example of a biased marker 1. The embodiment shown uses a hemispherical shaped housing 2 made of a clear rubber material. This housing 2 encloses the componentry of the marker 1. The marker 1 is set into an aperture in the surface 16 such as a road 16. A casing 17 that mates with the housing 2 is used along with a bias mechanism, in this examples springs or pistons 19. The bias action of the bias mechanism 19 forces the marker 1 upwards. The casing 17 has a lip around the casing circumference that abuts and retains the housing 2 within the surface 16 aperture during normal operation. When a force is applied to the top of the housing 2, the housing 2 is depressed into the surface 16 aperture against the bias action 19 thereby dropping the marker 1 within the surface 16. By varying the aperture depth and bias travel, the marker 1 can be set to fully depress into the surface 16. When the force is removed, the bias action 19 then forces the marker 1 back up to a normal operation or non-depressed position. This mechanism allows the marker 1 to depress when a downward force is applied thereby avoiding the marker 1 being removed by a snowplough or heavy vehicle.

Figure 8:
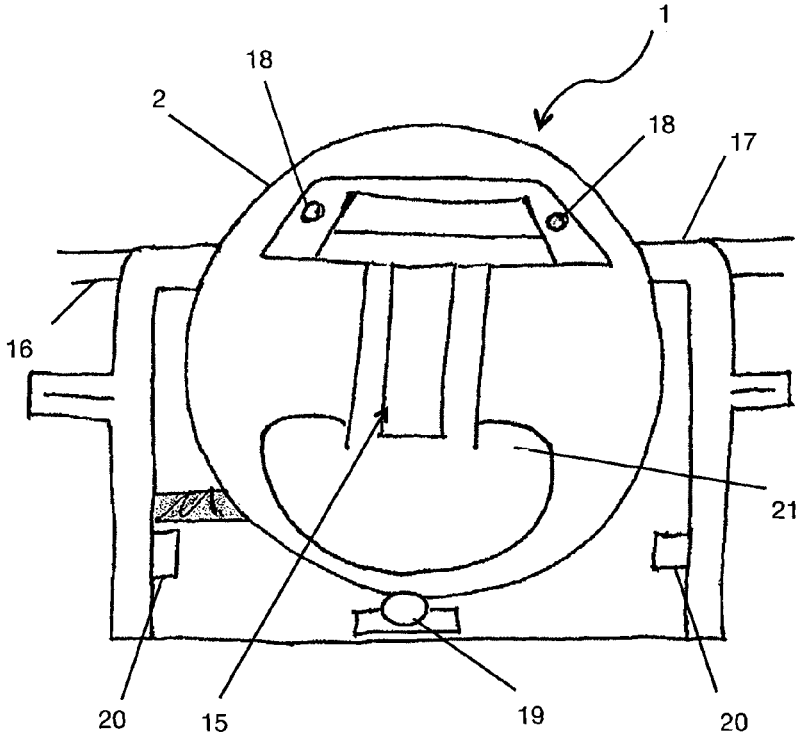
FIG. 8 illustrates an alternative embodiment of a biased marker.

FIG. 8 illustrates an alternative biased embodiment where the marker 1 housing 2 is a ball shape retained within a casing 17 inside an aperture in a surface 16. The ball housing 2 is manufactured from a transparent and resilient material such as rubber. The marker 1 components such as LEDs 18 and battery 15 are retained within the ball 2. The ball housing 2 also includes a counter weight 21 that weights the bottom of the ball 2 so that the marker 1 tends to remain in position with the LED lights 18 and a portion of the ball 2 sitting proud of the surface 16. The ball 2 is biased up relative to the surface 16 by a sprung bearing 19 and the bias action forces the ball 2 against a casing annulus 17. When a downward force is applied such as that experienced from a heavy vehicle or a snowplough, the ball 2 is forced downwards against the sprung bearing 19. The force may also be transferred into rotational motion on the ball 2 that is free to spin within the casing 17. The ball 2 may also include a magnet or magnets (not shown) that are attracted to a magnet or magnets 20 on the casing 17. The magnets 20 may be used to slow or self-correct rotational movement of the ball 2 in addition to a counter balance weight 21.

Figure 9:
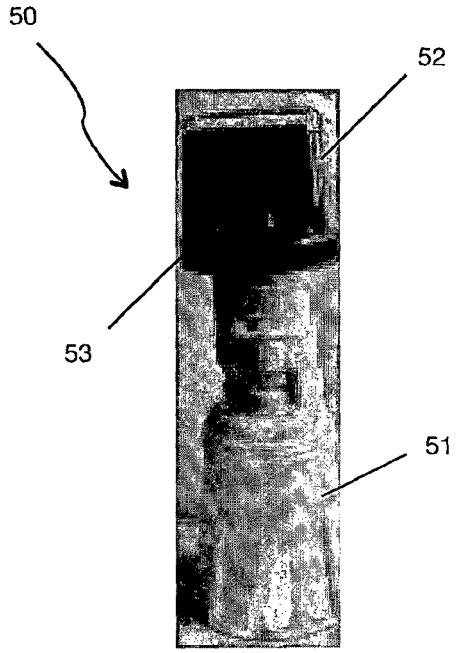
FIG. 9 illustrates a beacon embodiment.

FIG. 9 shows an alternative device being a beacon 50 utilising many of the same components and principles of the marker 1 described above. The beacon 50 includes a solar panel (not shown) linked with an energy source (not shown) and one or more LED lights 53. The LED lights 53 are set into a housing 52 that retains the various components of the assembly. The housing 52 may be set onto a support or sleeve 51. This sleeve 51 may be positioned over a road cone for example (not shown), or made sufficiently large to use as a warning cone in itself.

Figure 10:
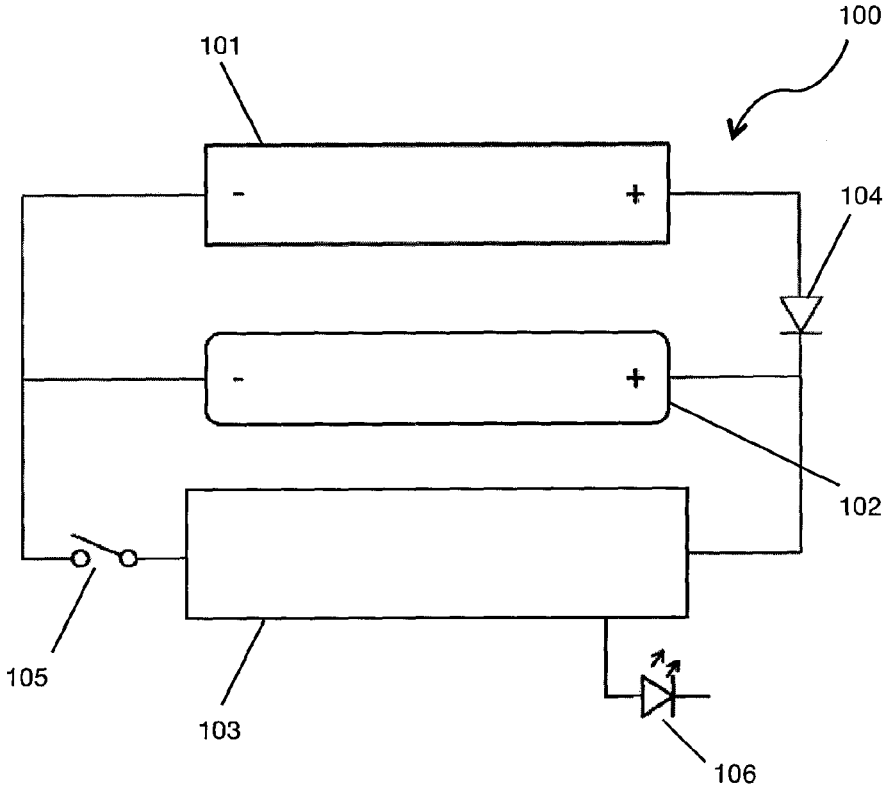
FIG. 10 illustrates a simple schematic example of a circuit arrangement for a road marker or beacon embodiment.
Figure 11:
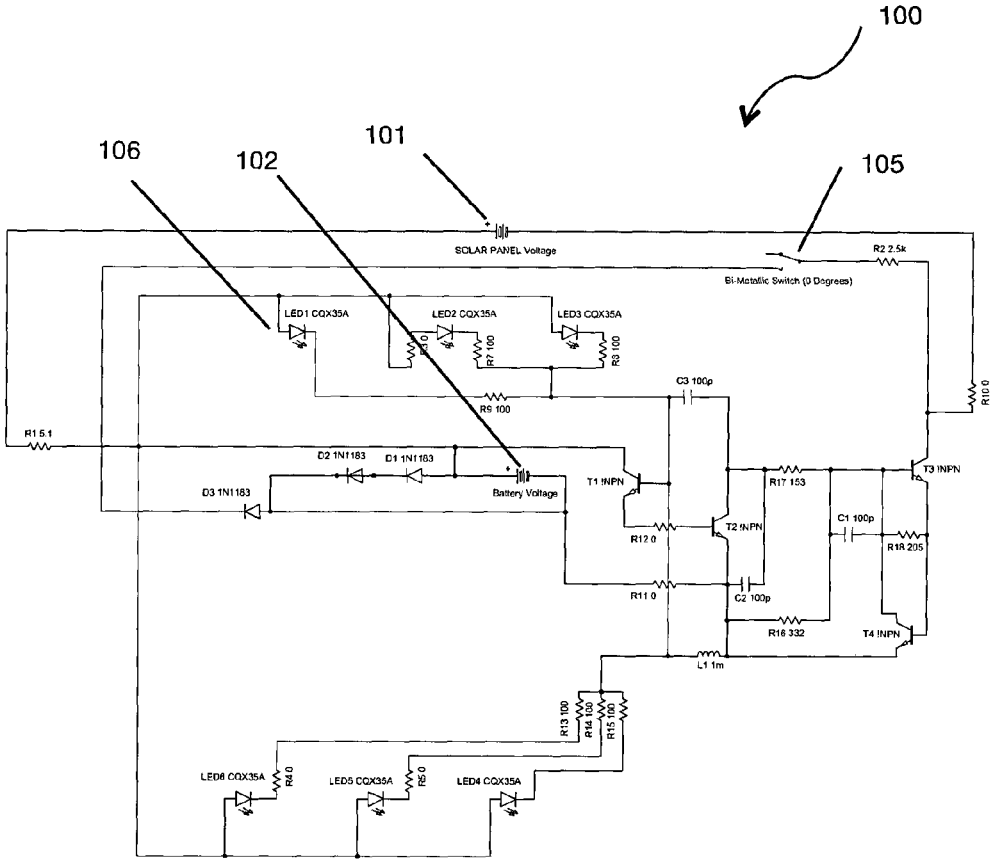
FIG. 11 illustrates a detailed circuit diagram of one embodiment for a road marker.

FIG. 10 shows a simplified schematic of the circuitry 100 inside the marker 1 or device 50. FIG. 11 shows a more detailed circuit diagram of one embodiment of road marker 1 circuit 100. The circuit 100 may include a solar panel 101 linked in parallel with a battery 102 and a circuit board 103. The connection between the solar panel 101 and the battery 102 includes a one-way diode 104 preventing reverse flow of electricity thus avoiding draining of the battery 102 in low light energy situations. The circuit 100 also includes a switch 105 being a thermal sensor switch such as a bimetal switch. The circuit 100 links to one or more LED lights 106.

Choice of a bimetal switch 105 has been identified as advantageous since the switch 105 inherently has a degree of hysteresis. Hysteresis is often avoided in switch where an accurate off/on tolerance is usually favoured. In the case of the marker 1 and devices 50 described herein, the opposite is true where a degree of hysteresis is very important to avoid the circuit 100 turning off and on rapidly in a cycle. Instead the circuit should only turn off once a sufficiently warm temperature is reached where no ice is likely in road warning applications and only turning on and staying on when ice is a likelihood. Rapid on/off cycling may be confusing to the motorist and may result in more rapid deterioration of the componentry. The switch 105 ideally turns the circuit 100 on when ice is a risk and off when ice formation is longer a risk. The exact temperature may vary from location to location but illumination occurs at around 1-2° C.

In operation, the solar panel 101 generates a 2.2-volt charge to the circuit board 103. In the event of no light energy, the battery 102 provides power to the circuit board 103. The battery 102 may have a power output of approximately 1.2 volts. The circuit board 103 shown includes a flasher circuit so that, when the switch 105 is on, the flasher circuit is operational and generates a pulse of light from the LED light 106 or lights 106. The pulse or flash occurs on a 1-5 Hz frequency, this frequency varying depending on the level of power received by the circuit board 103. The flasher circuit includes an LCR circuit so as to store and build charge that is then released in each pulse or flash. The result is that a 4-volt flash can be generated using either the 1.2-volt battery 102 power source or the 2.2-volt solar panel 101 power source. The frequency of flash varies however depending on energy input with a slower frequency from a lower voltage input versus a higher rate from a higher voltage input, Notably, all of the above components are passive electrical components. This is important to reduce the energy requirements of the circuit 100 and therefore reduce costs and maintenance requirements. Also unexpectedly, the components are remarkably heat stable. Use of a microcontroller for example is not possible for at least a road marker 1 application as the temperature at which tar is used during road manufacture (and the temperature that the marker 1 is thus subjected to when paid on a road) melts or damages the microcontroller. In contrast the passive components used are remarkably tolerant of the high heat experienced during road sealing—up to 190° C. The passive components minimise voltage to less than 4 volts, more typically less than 2.5 volts, When the ambient light level exceeds a predetermined level, the PV module 5, 101 charges the rechargeable battery 21, 102. When the ambient light level falls below a predetermined level, the rechargeable battery 21, 102 supplies power to the circuit.

Car light may also be used to generate power from the PV module although a more continuous energy source such as the sun is preferable.

Figure 2:
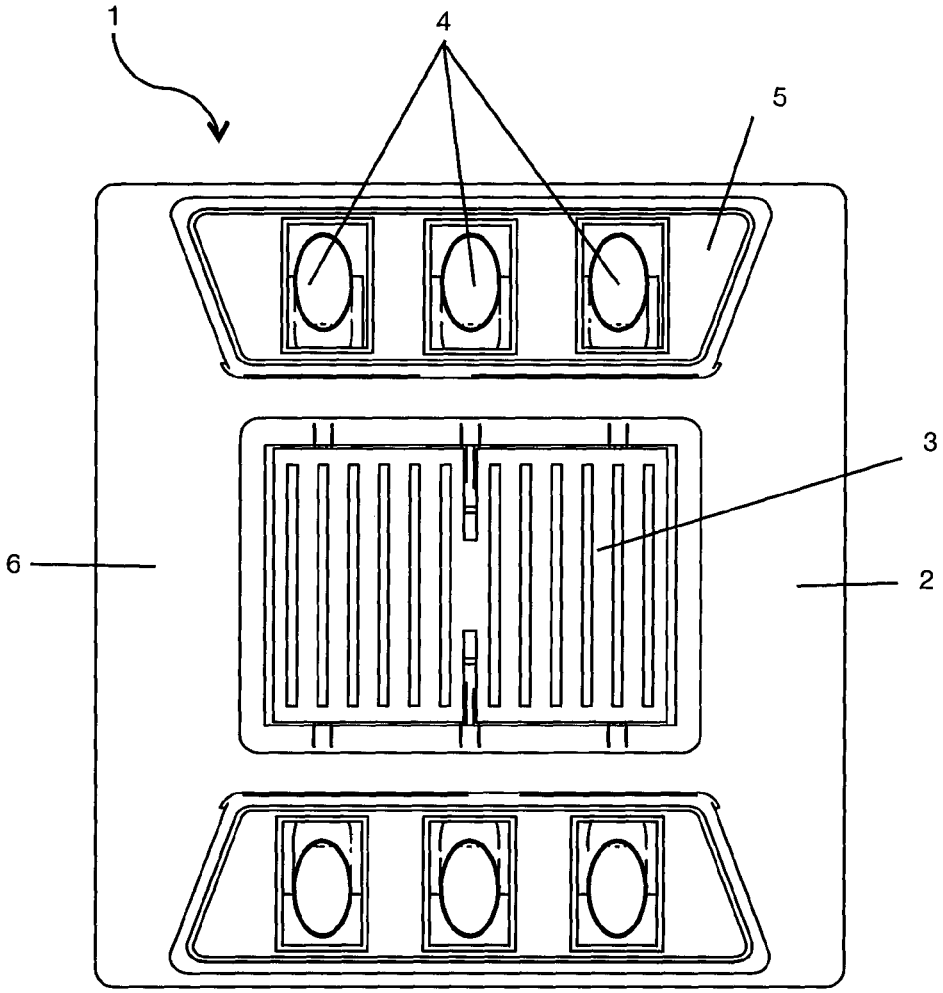
FIG. 2 illustrates a top view of a road marker.
Figure 3:
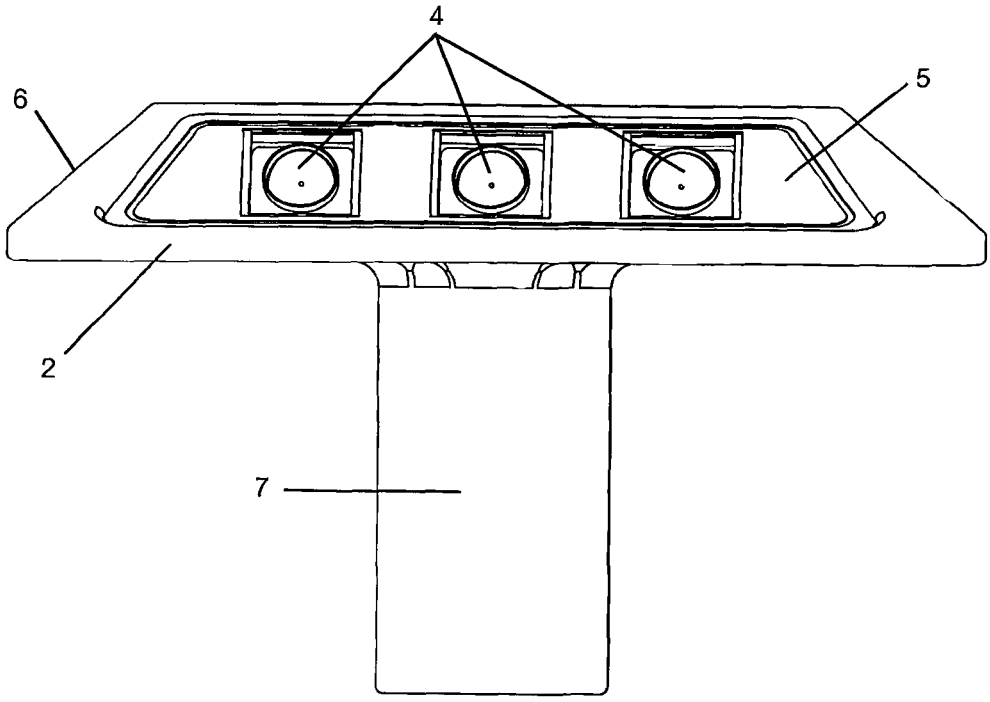
FIG. 3 illustrates a front view of a road marker.
Figure 4:
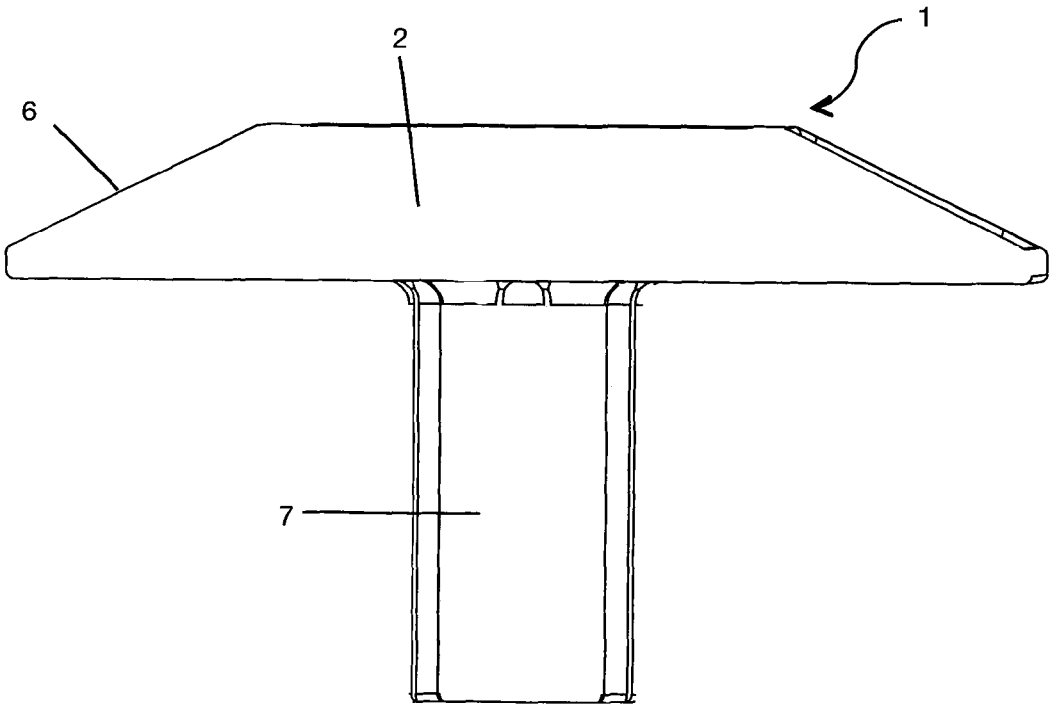
FIG. 4 illustrates a side view of a road marker.

As shown in at least FIG. 2, a light-emitting diode array 106 may be used. The LED's may be arranged in various patterns to form shapes or even words such as the word "ICE".

The road marker 1 or device 50 may be used to warn motorists of temperature related hazards by installing at least one road marker 1 or device 50 to a surface e.g. the road, a handrail or a lamppost. Typically, multiple markers or devices would be installed in a target area. At least one light-emitting diode 7, 106 is illuminated in a flashing pattern by the circuit 100 when the thermal sensor 20, 105 detects a predetermined temperature. In this way, motorists may be alerted to the presence of ice such as black ice and potentially other temperature related road hazards, Aspects of the road marker and device have been described by way of example only and it should be appreciated that modifications and additions may be made thereto without departing from the scope of the claims herein.

What is claimed is:

1. A road marker including a metal housing with at least one surface of the housing being transparent, the housing enclosing passive electrical components including:

(a) a circuit board;

(b) a thermal sensor coupled to an input terminal on the circuit board wherein the thermal sensor has at least 0.5° C. of hysteresis to prevent rapid on/off cycling of the at least one light-emitting diode;

(c) a photovoltaic (PV) module coupled to an input terminal on the circuit board;

(d) at least one energy storage element coupled to an input terminal on the circuit board; and (e) at least one light-emitting diode coupled to an output terminal of the circuit board;

wherein the at least one light-emitting diode illuminate when the thermal sensor detects a predetermined temperature.

2. The road marker as claimed in claim 1 wherein the passive electrical components are located within the housing and there are no external parts outside the housing.

3. The road marker as claimed in claim 1 wherein the thermal sensor is at least one bimetallic switch.

4. The road marker as claimed in claim 1 wherein the degree of hysteresis is biased towards the at least one light-emitting diode remaining illuminated until at least 0.5° C. or higher than the set temperature so as to ensure that temperature conditions are suitably warmer than a temperature considered hazardous.

5. The road marker as claimed in claim 1 wherein the housing is biased to a position where at least the at least one light emitting diode in the housing sits proud of a surface to which the road marker is applied and wherein, when a force is applied against the bias direction, the housing is depressed into the surface.

6. The road marker as claimed in claim 1 wherein the circuit board includes a single forward biased diode between the PV module and the at least one energy storage element preventing energy leakage from the at least one energy storage element when light energy is insufficient to power the PV module.

7. The road marker as claimed in claim 1 wherein the circuit board includes an LCR circuit sufficient to generate a pulse of at least 2 volts to drive a flash from the at least one light emitting diode.

8. The road marker as claimed in claim 7 wherein the pulse is at least 4 volts.

9. The road marker as claimed in claim 1 wherein the road marker produces a flashing output at a frequency of 1-5 Hz when illuminated.

10. The road marker as claimed in claim 1 wherein the predetermined temperature is less than or equal to an ambient and/or surface temperature of 5° C.

11. The road marker as claimed in claim 1 wherein the road marker includes multiple light emitting diodes arranged to form a word or shape when illuminated.

12. The road marker as claimed in claim 11 wherein the light emitting diodes are arranged to form the word ICE when illuminated.

13. The road marker as claimed in claim 1 wherein the road marker is a cat's eye.

14. The road marker as claimed in claim 1 wherein the road marker is placed or fixed to a road surface.

15. The road marker as claimed in claim 1 wherein the road marker is placed or fixed to an intermediate structure.

* * * * *